US006034713A

United States Patent [19]

Kerr et al.

[11] Patent Number: 6,034,713

[45] Date of Patent: Mar. 7, 2000

[54] IMAGE PROCESSOR HAVING MAGNETICALLY ATTACHED PRINT HEAD

[75] Inventors: Roger S. Kerr, Brockport; Svetlana Reznik, Rochester; Edward P. Furlani, Lancaster, all of N.Y.

[73] Assignee: Eastman Kodak Company, Rochester, N.Y.

[21] Appl. No.: 08/861,119

[22] Filed: May 21, 1997

[51] Int. Cl.[7] ..... B41J 29/02

[52] U.S. Cl. ..... 347/257

[58] Field of Search ..... 347/257, 242, 347/37, 245, 263, 197, 198; 400/120.16, 120.17

[56] References Cited

U.S. PATENT DOCUMENTS

| | | | |
|---|---|---|---|
| 5,415,483 | 5/1995 | Franklin, Jr. | 400/328 |
| 5,818,497 | 10/1998 | Kerr et al. | 347/234 |
| 5,838,345 | 11/1998 | Kerr et al. | 347/37 |

FOREIGN PATENT DOCUMENTS

| | | | |
|---|---|---|---|
| 0 529 563 A2 | 3/1993 | European Pat. Off. | B41J 29/02 |
| WO 92/09976 | 6/1992 | WIPO | G06K 15/12 |

OTHER PUBLICATIONS

EPO Communication—"European Search Report" dated Sep. 18, 1998.

*Primary Examiner*—N. Le
*Assistant Examiner*—Michael Nghiem
*Attorney, Agent, or Firm*—Peyton C. Watkins

[57] ABSTRACT

An imaging processor for receiving a medium for writing thereon, the processor comprises an imaging receptacle for receiving the medium. A print head is disposed in the imaging processor for directing a laser onto the medium, and a translation table includes a magnet thereon for magnetically attracting the print head for ultimately providing alignment of the print head relative to the imaging receptacle.

9 Claims, 3 Drawing Sheets

IMAGE PROCESSOR HAVING MAGNETICALLY ATTACHED PRINT HEAD

FIELD OF THE INVENTION

The invention relates generally to the field of lathe bed scanners having a print head for directing a laser onto a medium resting on a drum for writing on the medium and, more particularly, to such print heads which are magnetically attached to the lathe bed scanner for providing repeatable and precision alignment with the drum.

BACKGROUND OF THE INVENTION

Color-proofing is the procedure used by the printing industry for creating representative images that replicate the appearance of printed images without the cost and time required to actually set up a high-speed, high-volume printing press to print an example of the images intended. One such color proofer is a lathe bed scanner which utilizes a thermal printer having half-tone capabilities. This printer is arranged to form an image on a thermal print medium, or writing element, in which a donor transfers a dye to the writing element upon a sufficient amount of thermal energy. This printer includes a plurality of diode lasers which can be individually modulated to supply energy to selected areas of the medium in accordance with an information signal.

A print-head includes one end of a fiber optic array having a plurality of optical fibers that are coupled to the diode lasers for transmitting the signals from the laser to the print head. The writing element is supported on a rotatable imaging drum, and the print-head with the fiber optic array is movable relative to the longitudinal axis of the drum. The dye is transferred to the writing element as the radiation, transferred from the diode lasers to the donor element by the optical fibers, is converted to thermal energy in the donor element.

The print head rests on a translation table of the lathe bed scanner and clamps are placed atop a portion of the print head and are clamped to the translation table for holding the print head thereto.

Although the presently known and utilized scanner is satisfactory, it is not without drawbacks. The translation table is precision machined so that the print head rests in a predetermined position on the translation table. Further, clamps require tedious calibration of the print head for maintaining focus and head angle.

Consequently, a need exists for improvements in the construction of the lathe bed scanner so as to overcome the above-described shortcomings.

SUMMARY OF THE INVENTION

The present invention is directed to overcoming one or more of the problems set forth above. Briefly summarized, according to one aspect of the present invention, the invention resides in an imaging processor for receiving a medium for writing thereon, the processor comprising: (a) an imaging receptacle for receiving the medium; (b) a print head for directing a laser onto the medium; and (c) a translation table having a magnet for magnetically attracting said print head for ultimately providing alignment of said print head relative to said imaging receptacle.

It is an object of the present invention to overcome the above-described drawbacks.

It is an advantage of the present invention to provide a cost-efficient device for implementing the present invention.

It is a feature of the present invention to provide a translation table having a magnet for magnetically attracting a print head for ultimately providing alignment of the print head relative to the imaging receptacle.

The above and other objects of the present invention will become more apparent when taken in conjunction with the following description and drawings wherein identical reference numerals have been used, where possible, to designate identical elements that are common to the figures.

DETAILED DESCRIPTION OF THE INVENTION

Figure 1:
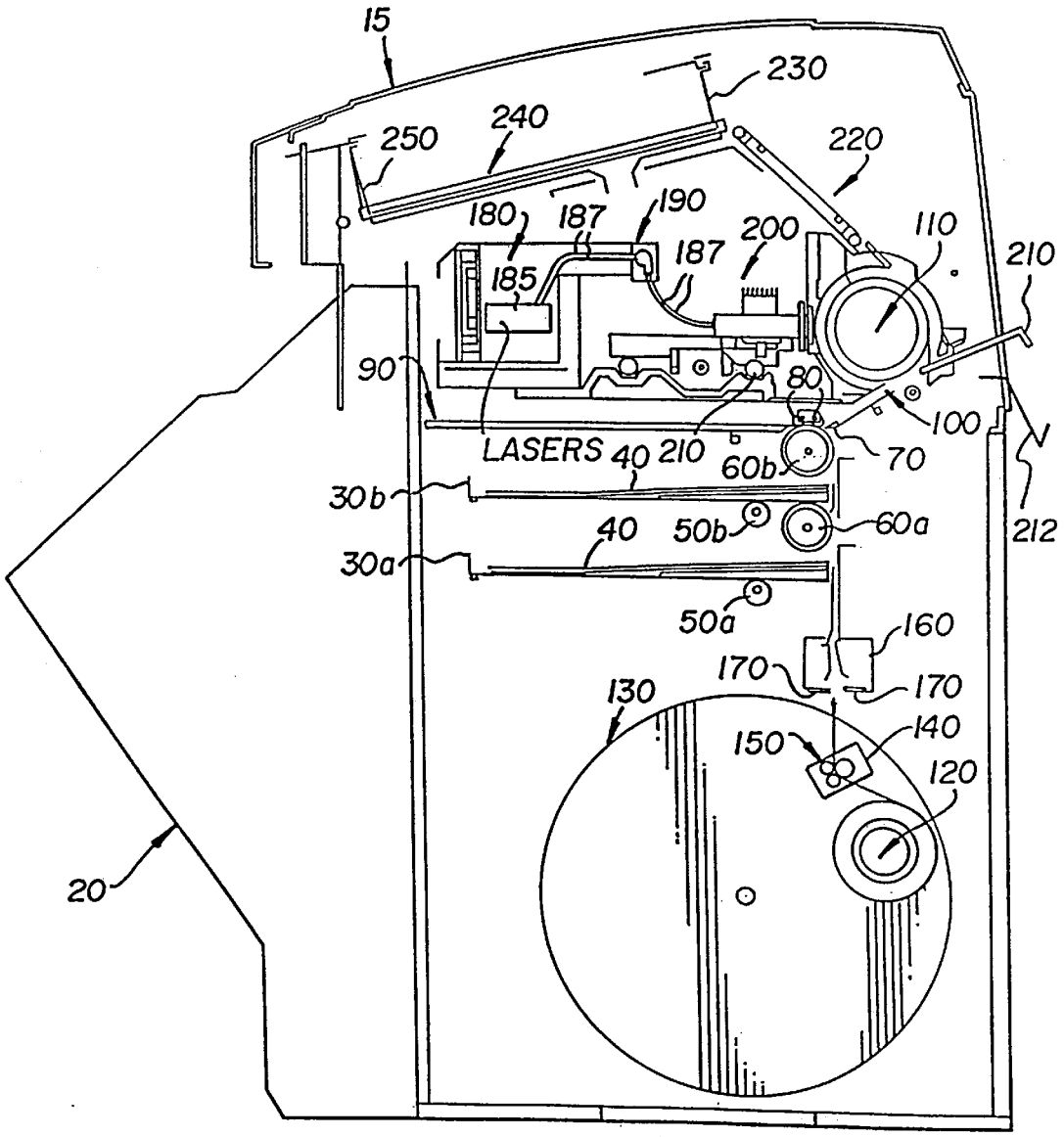
FIG. 1 is a side view in vertical cross section of a lathe bed scanner of the present invention.

Referring to FIG. 1, there is illustrated a lathe bed scanner 10 of the present invention having a housing 15 for forming a protective cover. A movable, hinged door 20 is attached to a front portion of the housing 15 for permitting access to two media trays, a lower tray 30*a* and upper tray 30*b*, that are positioned in an interior portion of the housing 15 for supporting receiver material 40, typically paper, thereon. It is obvious to those skilled in the art that only one media tray 30 will dispense receiver material 40 out of its paper tray 30 for creating an image thereon; the alternate media tray 30 either holds an alternative type of paper or functions as backup. In this regard, the lower media tray 30*a* includes a cam 50*a* for lifting the paper 40 upwardly toward a rotatable, lower media roller 60*a* and, ultimately, toward a second rotatable, upper media roller 60*b* which, when both are rotated, permits the receiver material 40 to be pulled upwardly towards a media guide 70. The upper media tray 30*b* also includes a cam 50*b* for lifting the receiver material 40 toward the upper media roller 60*b* which directs it towards the media guide 70.

As illustrated by the phantom position, the movable media guide 70 directs the receiver material 40 under a pair of rollers 80 which engages the receiver material 40 for assisting the upper media roller 60*b* in directing it onto a staging tray 90. The media guide 70 is attached and hinged to the interior of the housing 15 at one end, and is uninhibited at its other end for permitting multiple positioning of the media guide 70. The media guide 70 then rotates its uninhibited end downwardly, as illustrated by the solid line, and the direction of rotation of the upper media roller 60*b* is reversed for forcing the receiver material 40 resting on the staging tray 90 back under the rollers 80, upwardly through an entrance passageway 100 and around a rotatable imaging drum 110.

Four rolls of donor material 120 (only one is shown) are connected to a carousel 130 in a lower portion of the housing 15, and each roll includes a donor material 120 of a different color, typically black, yellow, magenta and cyan. These donor materials are ultimately cut into sheets and passed to the imaging drum for forming a medium from which dyes imbedded therein are passed to the receiver material resting thereon, which process is described in detail herein below. In this regard, a drive mechanism 140 is attached to each roll 120, and includes three rollers 150 through which the donor material 120 of interest is rolled upwardly into a knife assembly 160. After the donor material 120 reaches a predetermined position, the rollers 150 cease driving the donor material 120 and two blades 170 positioned at the bottom portion of the knife assemble cut the donor material 120 into a sheet. The media rollers 60*a* and 60*b* and media guide 70 then pass the donor material 120 onto the drum 110 and in registration with the receiver material 40 using the same process as described above for passing the receiver material 40 onto the drum 110. The donor material 120 rests atop the receiver material 40 with a narrow gap between the two created by microbeads imbedded into the receiver material 40.

A laser assembly 180 includes twenty lasers 185 in its interior, and these lasers are connected via fiber optic cables 187 to a coupling head 190 and ultimately to a write head 200. The write head 200 creates thermal energy from the signal received from the lasers 185 causing the donor material 120 to pass its dye across the gap to the receiver material 40. The write head 200 is attached to a lead screw 210 via a nut (not shown in FIG. 1) for permitting it to move axially along the longitudinal axis of the drum 110 for writing data onto the receiver material 40.

For writing, the drum 110 rotates at a constant velocity, and the write head 200 begins at one end of the receiver material 40 and traverses the entire length of the receiver material 40 for completing the transfer process for the particular donor material resting on the receiver material 40. After the donor material 120 has completed its dye transfer, the donor material 120 is then transferred from the drum 110 and out of the housing 15 via a skive or ejection chute 210. The donor material eventually comes to rest on a donor material tray 212 for permitting removal by a user. The above-described process is then repeated for the other three rolls of donor material.

After all four sheets of donor material have transferred their dyes, the receiver material 40 is transported via a transport mechanism 220 through an entrance door 230 and into a dye binding assembly 240 where it rests against an exit door 250. The entrance door 230 is opened for permitting the receiver material 40 to enter into the dye binding assembly 240, and shuts once it comes to rest in the dye binding assembly 240. The dye binding assembly 240 heats the receiver material 40 for further binding the transferred dye on the receiver material 40 and for sealing the microbeads thereon. After heating, the exit door 250 is opened and the receiver material 40 with the image thereon passes out of the housing 15 and comes to rest against a stop 260.

Figure 2:
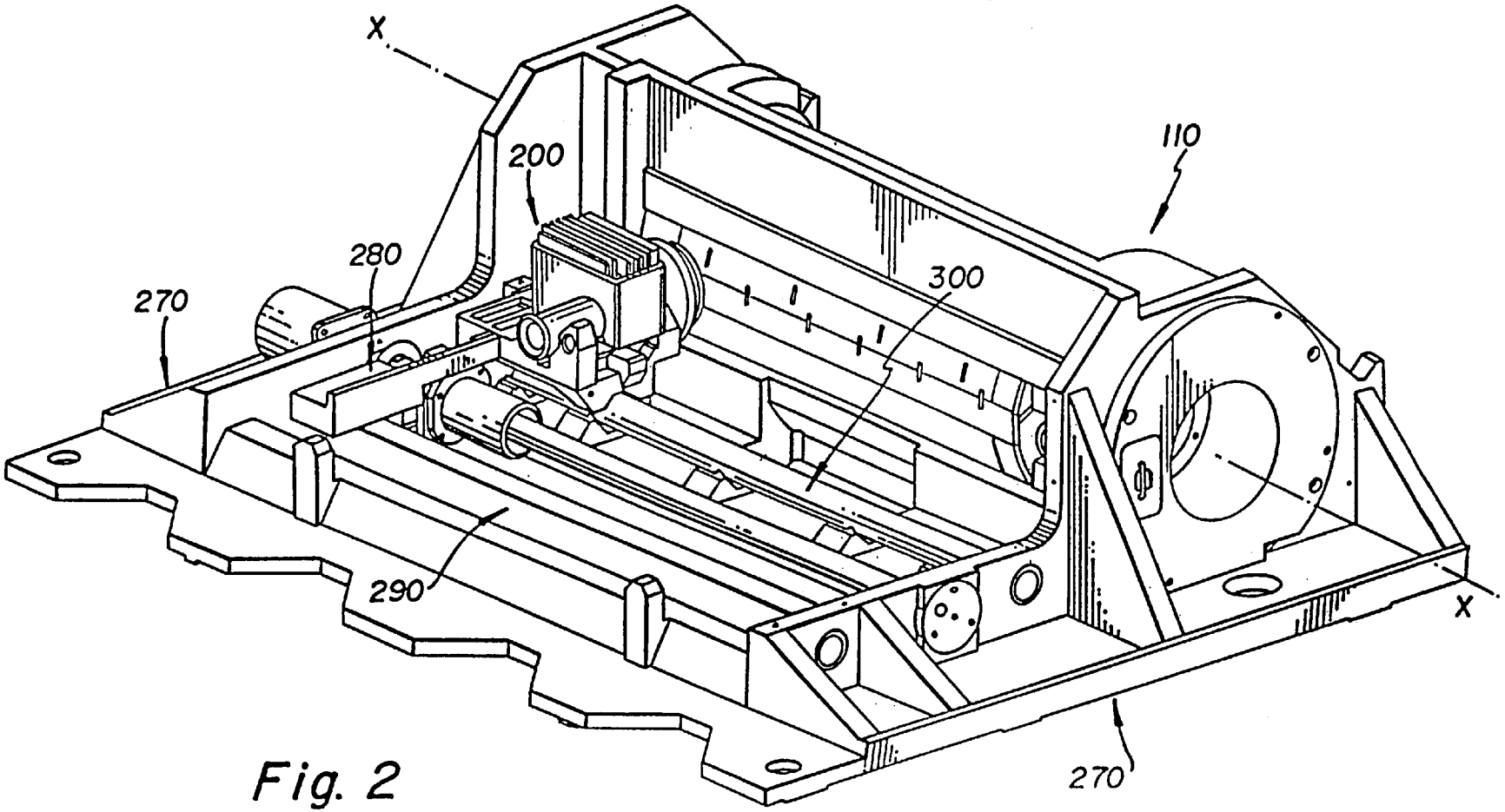
FIG. 2 is a perspective view of an imaging drum, laser writer and lead screw of the present invention.

Referring to FIG. 2, there is illustrated a perspective view of the imaging drum 110 and write head 200 of the lathe bed scanner 10. The imaging drum 110 is mounted for rotation about an axis (x) in a frame support 270. The write head 200 is movable with respect to the imaging drum 110, and is arranged to direct a beam of actinic light to the donor material 120 (shown in FIG. 1). The write head 200 contains therein a plurality of writing elements (not shown) which can be individually modulated by electronic signals from the laser diodes 185, which signals are representative of the shape and color of the original image, so that each dye is heated to cause volatilization only in those areas in which its presence is required on the receiver material 40 to reconstruct the color of the original object.

The write head 200 is mounted on a movable translator member 280 which, in turn, is supported for low friction slidable movement on bars 290 and 300. The bars 290 and 300 are sufficiently rigid so that they do not sag or distort between the mounting points at their ends and are arranged as parallel as possible with the axis (x) of the imaging drum 110. The upper bar 300 is arranged to locate the axis of the writing head 200 precisely on the axis (x) of the drum 110 with the axis of the writing head perpendicular to the drum axis (x). The upper bar 300 locates the translator member 280 in the vertical and the horizontal directions with respect to the axis of the drum 110. The lower bar 290 locates the translator member 280 only with respect to rotation of the translator about the bar 290 so that there is no over-constraint of the translator member 280 which might cause it to bind, chatter, or otherwise impart undesirable vibration to the writing head 200 during the generation of an image.

Figure 3:
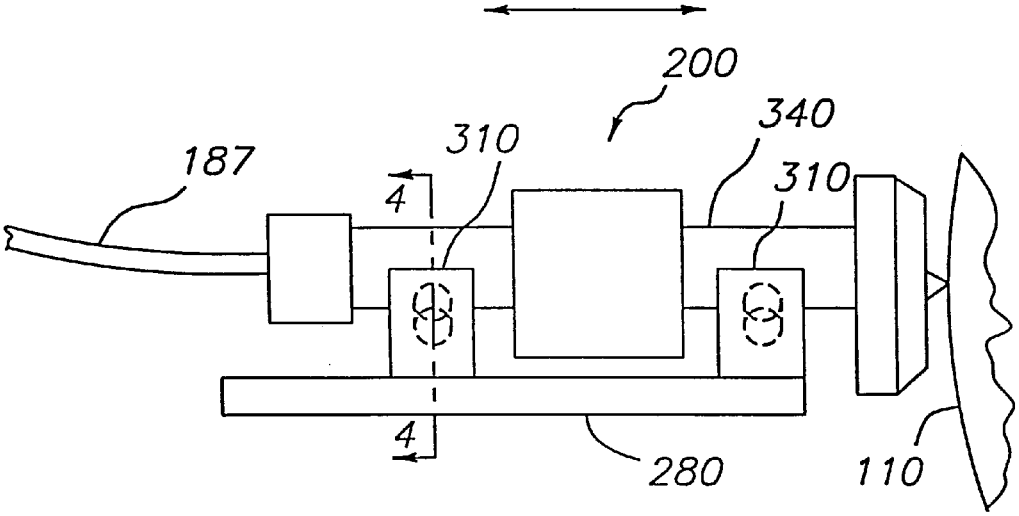
FIG. 3 is a side view of the print head and translation table of the scanner.
Figure 4:
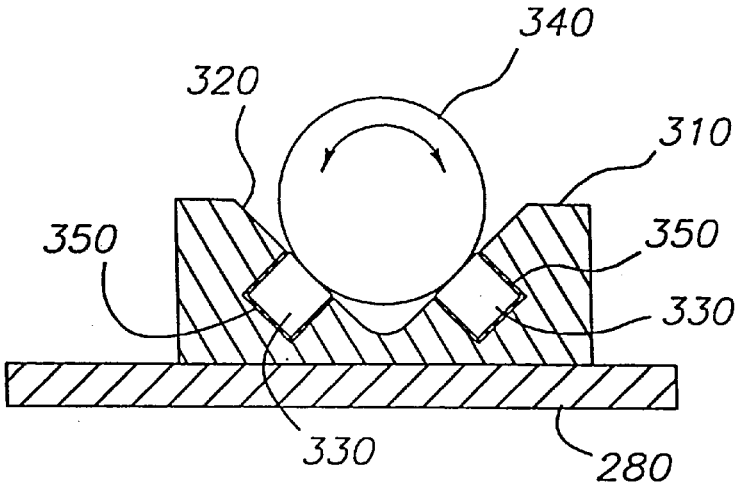
FIG. 4 is a cross-sectional view of FIG. 3.

Referring to FIGS. 3 and 4, there is illustrated the print head 200 resting on the translation table 280. The translation table includes a pair of support members 310 each having a notched out potion 320 for receiving the print head. A pair of cylindrical shaped magnets 330 are placed in each support member for magnetically attracting a barrel 340 of the print head 200 for maintaining the positional relationship of the print head 200. Each support member 310 includes a hollowed-out portion in which suitable epoxy 350 is placed for structurally attaching the magnets 330 to the translation table 280.

It is instructive to note that magnetically attaching the print head 200 to the translation table 280 permits easy adjustment of the print head 200. For example, the print read 200 can be moved inwardly and outwardly relative to the imaging drum 110 for focusing the print head 200. (see dashed arrows of FIG. 3) Still further, the print head 200 may be rotated for permitting the fiber optics 187 within the print head 200 to be oriented at a desired angle. (see solid arrow in FIG. 4)

The invention has been described with reference to a preferred embodiment However, it will be appreciated that variations and modifications can be effected by a person of ordinary skill in the art without departing from the scope of the invention.

| Parts List: | |
|---|---|
| 10 | scanner |
| 15 | housing |
| 20 | door |
| 30 | media tray |
| 30a | lower tray |
| 30b | upper tray |
| 40 | receiver material |
| 50 | cams |
| 50a | cam |
| 50b | cam |
| 60 | media rollers |
| 60a | lower media roller |
| 60b | upper media roller |
| 70 | media guide |
| 80 | rollers |
| 90 | staging tray |
| 100 | entrance passageway |
| 110 | imaging drum |
| 120 | rolls of donor material |
| 130 | carousel |
| 140 | drive mechanism |
| 150 | rollers |
| 160 | knife assembly |
| 170 | blades |
| 180 | laser assembly |
| 185 | lasers |
| 187 | optic cables |
| 190 | coupling head |
| 200 | write head |
| 210 | lead screw |
| 210 | ejection chute |

-continued

| Parts List: | |
|---|---|
| 212 | donor material tray |
| 220 | transport mechanism |
| 230 | entrance door |
| 240 | dye binding assembly |
| 250 | exit door |
| 260 | stop |
| 270 | frame support |
| 280 | translator member |
| 290 | lower bar |
| 300 | upper bar |
| 310 | support members |
| 320 | notched out portion |
| 330 | cylindrical-shaped magnet |
| 340 | barrel of the print head |
| 350 | suitable epoxy |

We claim:

1. An imaging processor for receiving a medium for writing thereon, the processor comprising:

(a) an imaging receptacle for receiving the medium;

(b) a print head for directing a laser onto the medium; and (c) a translation table having a magnet for magnetically attracting said print head for ultimately providing alignment of said print head relative to said imaging receptacle.

2. The imaging processor as in claim 1, wherein said translation table further comprises a support member for receiving said magnet.

3. The imaging processor as in claim 2, wherein said support member receives a plurality of magnets.

4. The imaging processor as in claim 1, where said support member further includes first and second support members for respectively receiving first and second magnets for magnetically attracting said print head.

5. The imaging processor as in claim 4, wherein said imaging receptacle is a circular shaped drum.

6. A method for maintaining the positional relationship of a print head in an imaging apparatus, the method comprising the steps of:

(a) placing the print head on a translation table and adjacent an imaging receptacle; and (b) attaching a magnet to the translation table for magnetically attracting the print head for ultimately providing alignment of the print head relative to the imaging receptacle.

7. The method as in claim 6 further comprising the step of attaching a plurality of magnets to the translation table.

8. The method as in claim 7 further comprising the step of integrally attaching a first support member to the translation table for receiving the plurality of magnets.

9. The method as in claim 8 further comprising the step of integrally attaching a second support member to the translation table for permitting both the first and second support members to receive the plurality of magnets.

* * * * *